US005105586A

United States Patent [19]

Jenne et al.

[11] Patent Number: 5,105,586

[45] Date of Patent: Apr. 21, 1992

[54] ABRADING TOOL AND METHOD OF MANUFACTURE

[75] Inventors: Walter F. Jenne, Elk Grove Village, Ill.; John R. Mason, Toledo, Ohio

[73] Assignee: The Yokohama Rubber Co., Ltd., Tokyo, Japan

[21] Appl. No.: 383,144

[22] Filed: Jul. 21, 1989

[51] Int. Cl.[5] ..... B24D 15/08

[52] U.S. Cl. ..... 51/293; 72/88; 72/90; 72/252.5; 76/101.1; 76/84; 51/204

[58] Field of Search ..... 51/205 WG, 205 R, 204, 51/293, 212; 72/88, 90, 252.5, 703, 199; 76/101.1, 84

[56] References Cited

U.S. PATENT DOCUMENTS

| | | | |
|---|---|---|---|
| 91,505 | 6/1869 | Wood | 76/84 |
| 1,273,441 | 7/1918 | Bardwell | 72/88 |
| 3,145,468 | 8/1964 | Johnson | 72/252.5 |
| 3,613,319 | 10/1971 | Takimura et al. | 72/252.5 |
| 4,751,795 | 6/1988 | Jenne | 51/205 WG |

FOREIGN PATENT DOCUMENTS

| | | | |
|---|---|---|---|
| 0092203 | 6/1980 | Japan | 72/252.5 |
| 0137041 | 8/1982 | Japan | 72/88 |
| 0140714 | 6/1988 | Japan | 72/252.5 |

*Primary Examiner*—Robert A. Rose
*Attorney, Agent, or Firm*—Armstrong, Nikaido, Marmelstein, Kubovcik & Murray

[57] ABSTRACT

An abrading tool and method of manufacture wherein a non-uniform abrading surface is formed on the tool by multiple passes of dies having similar non-uniform surfaces.

25 Claims, 6 Drawing Sheets

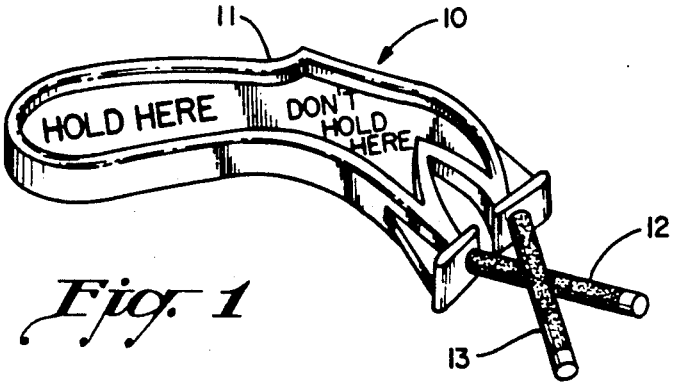
Fig. 1
Fig. 2
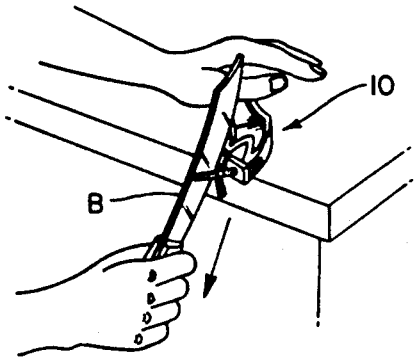
Fig. 3
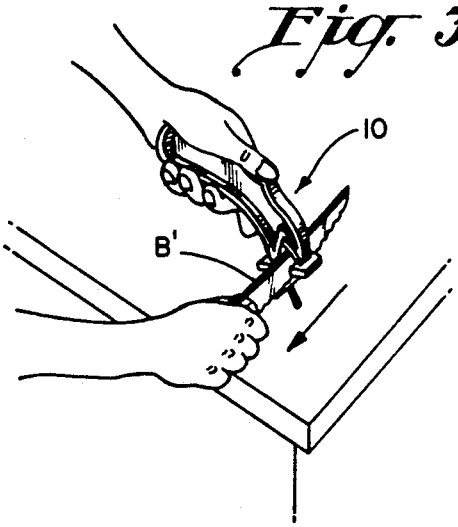
Fig. 4
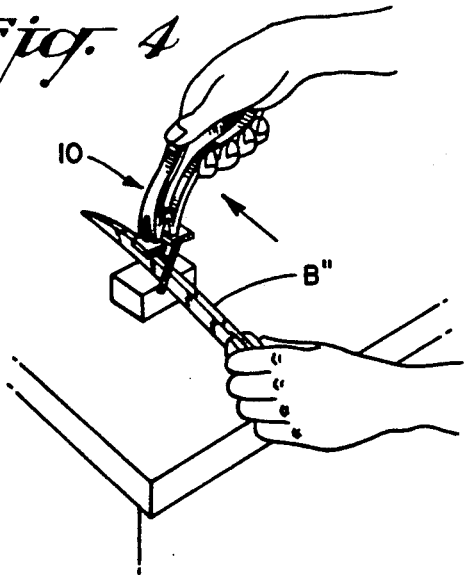
Fig. 5
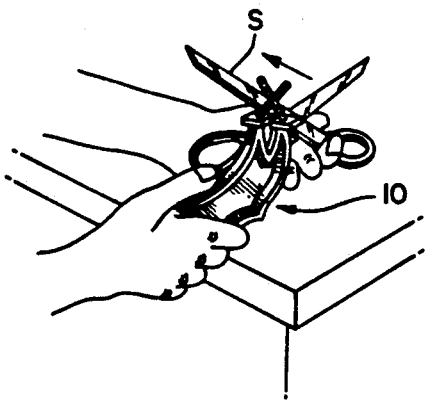

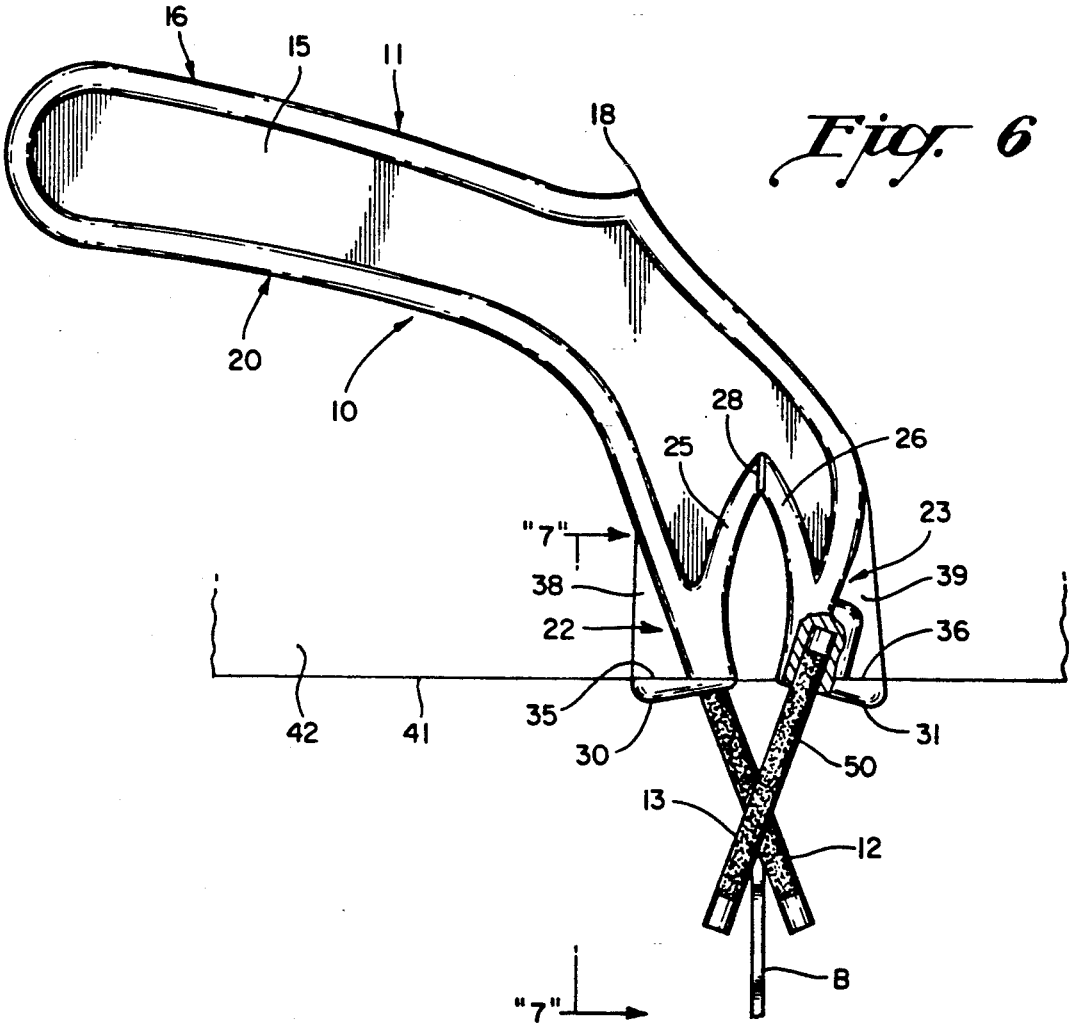
Fig. 6
Fig. 7
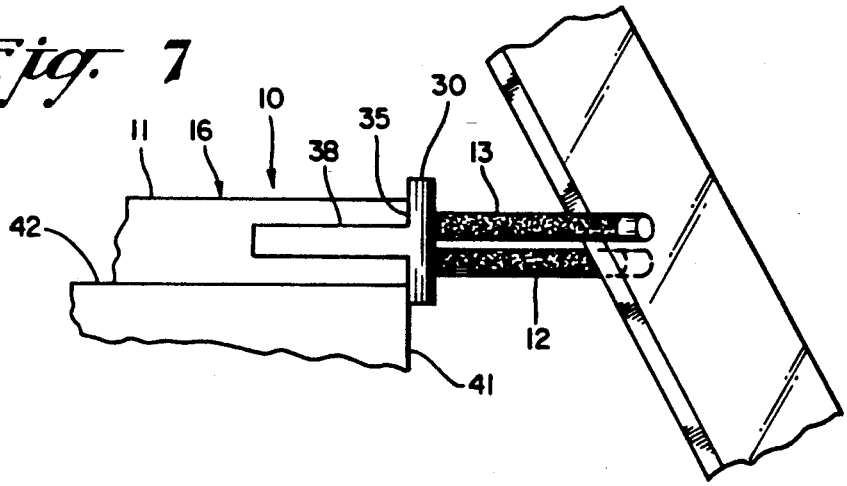

ABRADING TOOL AND METHOD OF MANUFACTURE

BACKGROUND OF THE INVENTION

There have in the past been provided a plurality of manual knife sharpening instruments that have achieved a considerable degree of commercial success and one such knife sharpening device includes a pair of crossed abrasive rods usually constructed of compressed ceramic or graphite powder, or in some cases serrated hardened steel. One of these is a table-mounted implement having a wooden base with a plurality of angularly related holes in the base that removably receive the abrasive rods. The base is rectangular and elongated and the user manually grasps one end of this base and forces it down against the supporting surface or table with the rods diverging generally vertically upwardly. This knife sharpening device has been found quite adequate, but it is not readily portable and in some positions of the device the user's supporting hand, i.e., the hand on the base, is somewhat close to the knife sharpening area subjecting it to some physical risk.

Another knife sharpening device that has found some success in the marketplace is a crossed abrasive rod sharpener having a short plastic handle. This device has also achieved considerable success in the marketplace and is reasonable safe but it does have the disadvantage that it cannot be supported on readily available supporting surfaces and it is also somewhat difficult to align with respect to the knife blade surfaces to be sharpened.

In U.S. Pat. No. 4,751,795 filed in the name of Walter F. Jenne entitled "IMPROVED KNIFE SHARPENER", a knife sharpening tool is disclosed that has a generally planar, elongated plastic handle or frame that permits the sharpener to be supported and used in a variety of effective positions with the user's hand well out of the way of the knife sharpening area and with relatively light manual pressure. The frame is arcuate in configuration and is bifurcated at one end defining a pair of support posts in which crossed knurled, hardened steel rods are insert molded. The bifurcated handle or frame posts define converging surfaces extending away from the rods that form a line-of-site for the user when sharpening a blade between the two rods.

These support posts also have aligned transverse projecting surfaces that are adapted to engage the side edges of a table or the like when the frame is supported on top of the table with the rods projecting over its edge. These surfaces align the rods so that a line bisecting the rods is perpendicular to the table edge permitting the user to have an accurate feel as to blade orientation with respect to the rods.

With this improved knife sharpener and in part due to the some six inch arcuate length of the sharpener and its planar configuration, the frame may be supported on top of a table or another rigid horizontal surface with the rods extending over the edge of the surface and the knife sharpened with only very light downward hand pressure on the handle.

While this knife sharpener has been found very suitable for sharpening, its knurled, hardened steel rods are quite abrasive and not suitable for honing previously sharpened knives. Attempts at replacing the knurled rods with rods roughened by sand blasting have not been particularly successful because rods roughened by conventional sand blasting techniques do not provide sufficient honing characteristics.

It is a primary object of the present invention to provide an abrading tool for honing and even sharpening that ameliorates the problems noted above.

SUMMARY OF THE PRESENT INVENTION

In accordance with the present invention, an abrading tool and method of manufacture are provided where the working surface of the tool has a non-uniform, cross sectional profile applied to the tool by a die having a similar non-uniform surface profile.

According to one embodiment of the present invention, a pair of flat rolling dies are formed by electrical discharge machining. Using an electrode with a flat smooth leading or working surface, and by increasing current flow through the electrodes and controlling electrode feed rate, a surface can be formed having an arithmetic mean deviation of roughness profile (Ra) in the range of 300 uin. to 800 uin. After suitable heat treating to harden the roughened surface, the die is utilized to transfer the roughened surface to either a flat or rod-shaped ferrous body that is subsequently heat treated for hardening, and the result is an extremely effective and low cost metalworking abrading tool.

By varying the roughness profile of the dies within this range, abrading tools can be manufactured having surface roughnesses of very fine honing tools to quite heavy metalworking files. Increased roughness is effected by in part increasing the current flow to the electrode during electrical discharge machining of the die. It has been found in utilizing this technique to produce Ra surfaces distributed in the range of 300 uin. to 800 uin., that the average arithmetic mean deviation of roughness with a high number of profile test runs actually remains fairly constant in a smaller range of approximately 400 uin. to 600 uin., and increased roughness is effected not so much by increasing Ra values but by an increase in the number of microscopically widely spaced large micro recesses in the die. That is, a single roughness profile over a standard evaluation length (1 m) of 0.090 inches in what may be termed a medium roughness die, may appear practically identical to another single run in a significantly coarser die. However, the coarser die upon examining a greater number of runs, has maximum peak to valley heights (Rt) as high as 7,000 uin. indicating the presence of these large micro recesses, while the maximum Rt values for the medium die are on the order of 3,000 uin. These large microscopic recesses produce the coarse abrading peaks when transferred by the die to the tool working surface.

The medium die, having arithmetic mean deviations distributed in the range of 400 uin. to 600 uin. with an average of approximately 500 uin. is utilized to manufacture extremely effective honing tools. In one embodiment, a pair of flat dies are used to roll steel rods that are subsequently hardened and utilized as knife honing instruments.

An important aspect of the present invention is that the working surface of the tool is formed by multiple passes of the die or dies. With flat rolling dies and cylindrical rod tools, the rods are rolled by the dies in multiple revolutions, preferably approximately 3. With annular dies and flat tools, two or three pairs of cooperating dies are required to effect this multiple surface working. By forming the roughened surface with two to four dies passes, a far greater surface uniformity is produced which is extremely important in tools such as hand-held knife honers where only one area of the steel rods is usually used for honing. If this area does not have the proper roughness, the tool becomes ineffective.

Other objects and advantages of the present invention will appear more clearly from the following detailed description.

BRIEF DESCRIPTION OF THE DRAWINGS

FIG. 1 is a perspective view of the present knife honer;

FIG. 2 is a perspective view of the present knife honer supported on a horizontal surface;

FIG. 3 is a perspective view of the present knife honer in a position to clean wavy or serrated edges;

FIG. 4 is a perspective view of the present knife honer in a position to hone fillet knives or odd-shaped knife blades;

FIG. 5 is a perspective view of the present knife honer in a position to hone scissors;

FIG. 6 is an enlarged top view of the present knife honer supported on a horizontal surface;

FIG. 7 is a fragmentary section taken generally along line 7—7 of FIG. 6;

DETAILED DESCRIPTION OF THE PREFERRED EMBODIMENTS

Figure 8:
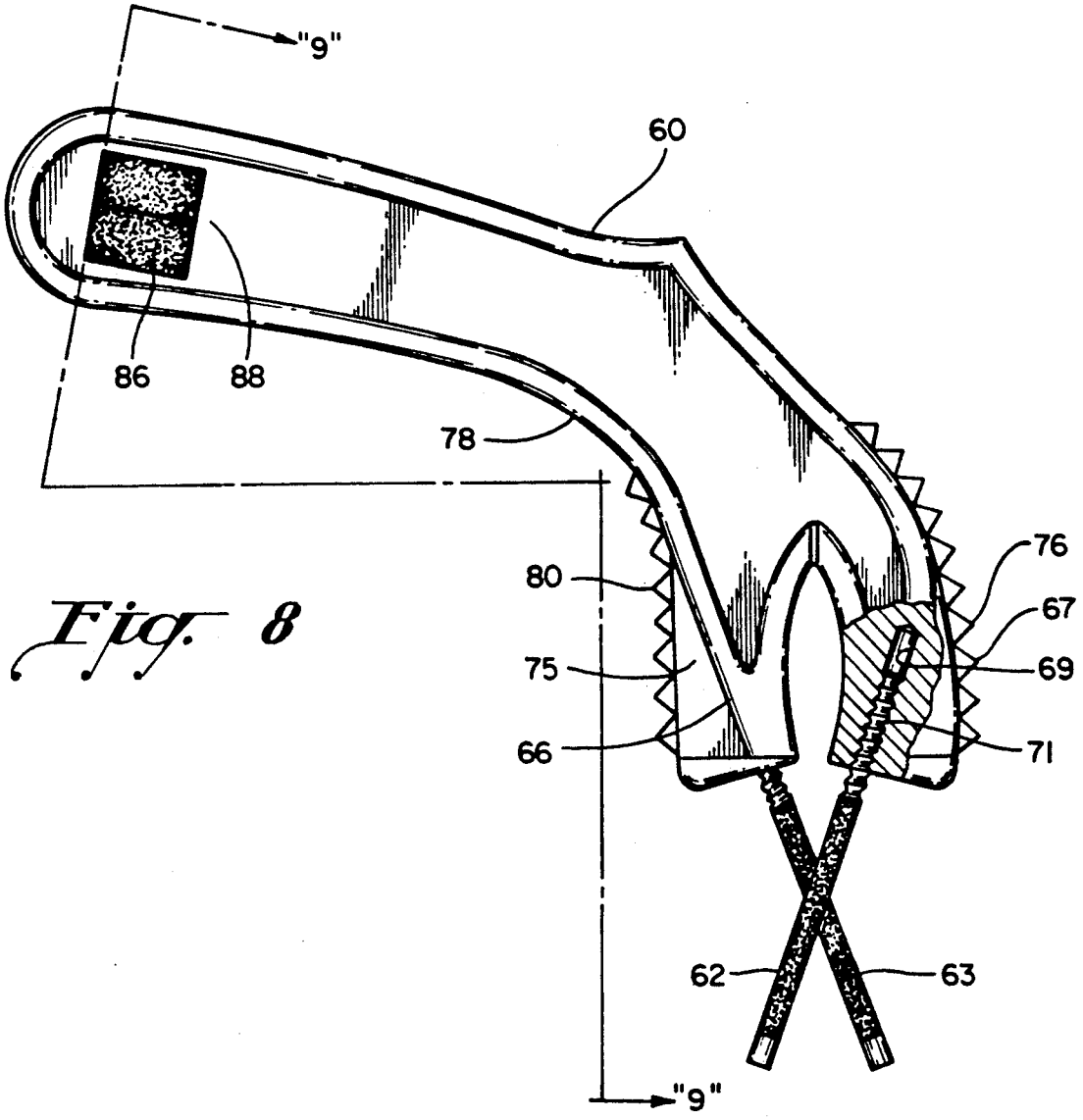
FIG. 8 is a plan view partly in section, of another embodiment of the present honing tool.

Referring to the drawings and particularly to FIGS. 1, 6 and 7, the present knife sharpening or honing device 10 is seen to include an elongated planar plastic frame or handle 11 and crossed roughened and hardened steel rods 12 and 13 produced according to the method of the present invention. As seen clearly in FIGS. 6 and 7, the rods 12 and 13 have axes lying and spaced parallel planes in the plane of FIG. 7 with the axes being crossed in the plane of FIG. 6 at an included angle of approximately 40 degrees. It should be understood that the tool 10 is not both a sharpener and a honer, and for a sharpener the rods 12, 13 would be courser than for a honer.

The handle or frame 11 may be constructed of an injection-moldable, high impact thermoplastic such as A.B.S., polypropylene or "Delrin" and as seen in FIGS. 6 and 7 includes a thin central web 15 approximately 3/16" surrounded by a transverse peripheral rim having a width of approximately 9/16".

The entire handle 16 has an arcuate length of approximately 7 inches along its centerline so that the user's hand may be positioned well away from the rods 12 and 13 during honing or sharpening. Rib 16 has a gentle apex approximately midway along its length at 18 that defines a pistol grip portion 20 for the handle 11. Pistol grip portion 20 is generally aligned with the rods 12, 13 so that the centerline of pistol grip portion 20 intersects a line bisecting the rods 12, 13 at an angle of approximately 105 degrees.

The forward end of the frame 11 is bifurcated and defines support posts 22 and 23 with undersized bores 50 into which rods 12 and 13 are pressed during assembly. The posts 12 and 13 have reduced arcuate rim portions 25 and 26 converging away from the rods 12 and 13 to an apex 28. The apex 28 lies on a line coincident with the line bisecting the rods 12 and 13 in the plane of FIG. 6. Apex 28 and converging rim portions 25 and 26 form a line of sight device to assist the user in aligning blade B (FIG. 6) on the line bisecting the rods 12, 13 so that both blade edges are honed or sharpened to equal angles.

The handle projections 22 and 23 have transverse projections 30 and 31 at their ends that extend outwardly beyond the rim 16, as seen clearly in FIG. 7. The projections 30 and 31 have aligned transverse edge-engaging surfaces 35 and 36 that extend in both directions from the web portions 38 and 39, both of which are in planar alignment with the main web 15 of the handle 11.

The transverse surfaces 35 and 36 are perpendicular to the plane of the handle 11 and also perpendicular to a plane extending parallel to and between the rods 12 and 13 perpendicular to the plane of FIG. 7. The edge surfaces 35 and 36, or more aptly termed "edge guides", when positioned in engagement with an edge 41 of a supporting surface 42, serve to align the rods 12 and 13 in a position so that the line bisecting the axes of the rods is perpendicular to edge 41, and they also and perhaps more importantly serve to support the entire knife sharpener or honer against the force of the blade B acting on the rods 12 and 13 in the direction of edge 41 as seen in FIGS. 6 and 7.

The sharpener-honer 10 is illustrated in FIG. 2 in its table-mount position for sharpening or honing conventional household as well as hunting knives. The sharpener-honer 10 is placed with its handle 11 flat on the table with edge guides 35 and 36 resting against the table edge and this holds it securely at a right angle to the table. The handle is held down with the one palm on the pistol grip area 20 and then with the other hand the user puts one knife edge against the crossed rods 12 and 13. The user then begins sharpening at the handle end of the blade, pulling down with mild pressure, using less pressure as the knife gets sharper.

In this position the knife edges also can be simultaneously sharpened or honed between the rods as seen in FIG. 6 using the sight alignment apex 28 as a visual guide.

In FIG. 3 the knife sharpener-honer 10 is shown in the generally vertical position with the rod ends against the table and this is particularly suitable for sharpening or honing knives with wavy or serrated edges. The blade is placed between the rods 12, 13 and between the posts 22 and 23 and the user pulls the knife through the opening between the posts in engagement with both rods on the line bisecting the axis of the rods.

In FIG. 4 the knife sharpener-honer 10 is illustrated in a position particularly designed to sharpen curved blades, fillet knives or other odd-shaped blades. In this position, the back edge of the knife is supported on a block or the like and with the knife sharpener 10 in a generally vertical position with the thumb resting on the thumb guide 18, the rods 13 and 14 are impaled over the knife B and the sharpener is dragged from the heel of the blade to the point.

Scissors may also be sharpened or honed when the sharpener-honer 10 is utilized in the position as shown in FIG. 5. One of the rods is drawn across each of the scissor blades from the pivot point towards the user several times.

It is also possible because of the press fit of rods 12 and 13 in bores 50 to rotate them slightly in the projections to provide a new sharpening-honing surface.

Figure 9:
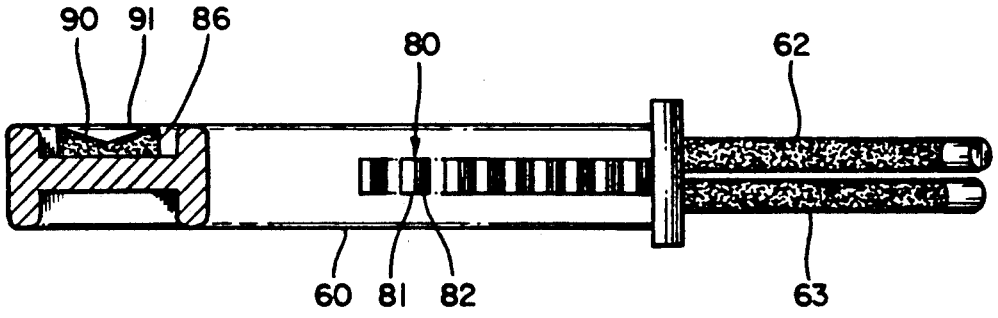
FIG. 9 is a partly fragmented side view taken generally along line 9—9 of FIG. 8.

In FIGS. 8 and 9 an alternative form of the present knife sharpener-honer is illustrated and is seen to include a handle 60 having the same general configuration as the handle 11 in the FIGS. 1 to 7 embodiment, and crossed roughened steel rods 62 and 63. As in the FIGS. 1 to 7 embodiment, the forward end of the handle is bifurcated and defines support posts 66 and 67 for the rods 63 an 62 respectively. Support posts 66 and 67, however, are somewhat longer. The bosses 66 and 67 have core-formed cylindrical bores 69 therein that are approximately one-quarter inch longer than the inner ends of the rods 62 and 63 when installed during manufacture.

The rods 62 and 63 are formed with self-tapping threads 71, part of which project from the bosses 66 and 67 when originally installed. After the original active surfaces on rods 62 and 63 have become worn after sharpening or honing for a period of time, the user rotates the rod 62 and 63 with pliers or vise threading the threaded portion 71 into bores 69 and exposing new fresh surfaces on the rods. Because the lead on the self-tapping portion 71 is substantial, after one to three 360 degree turns of the rods 62 and 63, the original worn areas on the rods 62 and 63 will not be in an active sharpening or honing position anymore since the rods will cross at a point closer to their distal ends as the rods are threaded further in bores 69. This combined rotational and axial movement of the rods 62 and 63 enables much greater surface areas on the rods to be utilized as sharpening or honing surfaces.

To further deter the user from hand-grasping the handle 60 adjacent the rods or steels 62 or 63, web portions 75 and 76 and portions of rim 78 have integrally molded sharp barbs 80 as seen in FIG. 9 defined by flat planar surfaces 81 and 82 that intersect along a lineal apex.

The FIGS. 8 and 9 embodiment also has the addition of a fish hook and sewing needle grinding stone 86 bonded to handle web portion 88 near its distal end. Stone 86 is generally rectangular in configuration and has a shallow V-shaped upper surface defined by surface portions 90 and 91 that facilitate hook sharpening.

As indicated above, the sharpening or honing steel rods 12, 13, 62 and 63 are formed according to the present invention by multiple pass rolling dies also with roughened working surfaces formed by electrical discharge machining. Presently the primary application for this method is the production of honing surfaces, but it should be understood that this method can also be utilized to produce heavier abrading tools such as metalworking tools classified as files. It should also be understood that while the honing rods illustrated in FIGS. 1 to 9 are cylindrical, this method can be utilized to produce abrading surfaces having a variety of surface shapes including the planar working surfaces illustrated in FIGS. 18 and 19.

Figure 12:
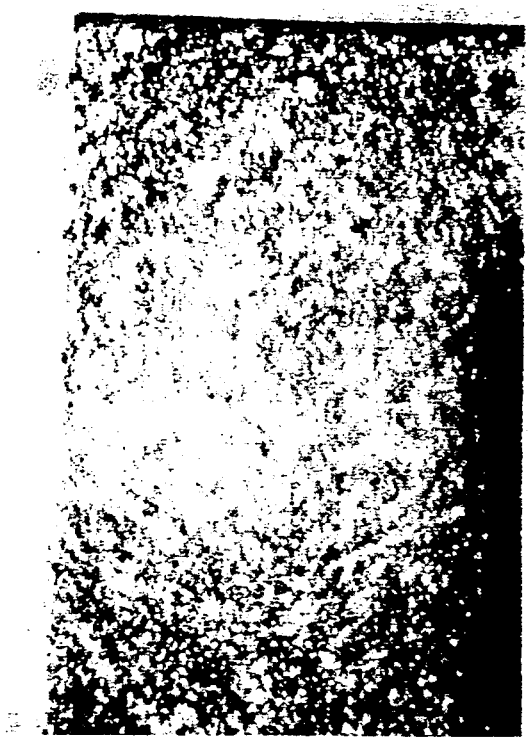
FIG. 12 is a micro photograph (5.3×) of the medium roughness die according to the present invention.
Figure 13:
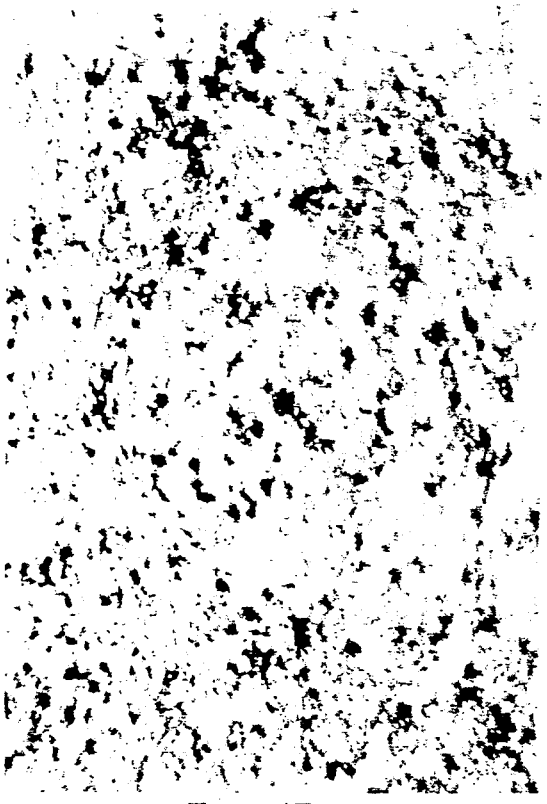
FIG. 13 is a micro photograph (5.3×) of the coarse roughness die according to the present invention.

Both the medium die illustrated in FIG. 12 and the coarse die illustrated in FIG. 13, are manufactured by substantially the same electrical discharge machining process. As is known, the shape of the surface formed by electrical discharge machining corresponds to the shape of an electrode. In the flat dies illustrated in FIGS. 12, 13, 16 and 17, the working surfaces are formed with an electrode having a flat smooth working surface, and an initially smooth die body surface. By increasing the current flow through the electrode over that normally utilized in EDM machining and controlling feed rate, the die body surface can be machined to a roughness in the desired range of arithmetic mean deviation of roughness between 300 uin. to 800 uin. The roughness can be varied from medium to coarse as defined herein by appropriate variation of electrode current flow and feed rate easily determined by experimentation by a skilled electrical discharge machining operator. The composition of the electrode itself will affect surface roughness.

The surface roughnesses of the dies according to the present invention have been tested and analyzed with a surface profile instrument. One such instrument that provides appropriate profile information is a surface texture parameter instrument, Model 201, Series 178, manufactured by Mitutoyo of Tokyo, Japan. This instrument provides enlarged print-outs of surface profiles, such as the ones redrawn in FIGS. 10 and 11, as well as a plurality of surface evaluation parameters including the arithmetic mean deviation of the roughness profile (Ra) and the maximum peak to valley height (Rt).

The Arithmetic Mean Deviation of the Roughness Pofile (Ra) is the arithmetic mean of the absolute value of the profile departures from the centerline within the evaluation length (1 m) and is represented by the following formula where the roughness profile is given as $y=f(x)$ with the (X) axis being the centerline and the y axis in the direction of vertical magnification:

$$Ra = \frac{1}{1m}\int_0^{1m} f(x)dx$$

Figure 10:
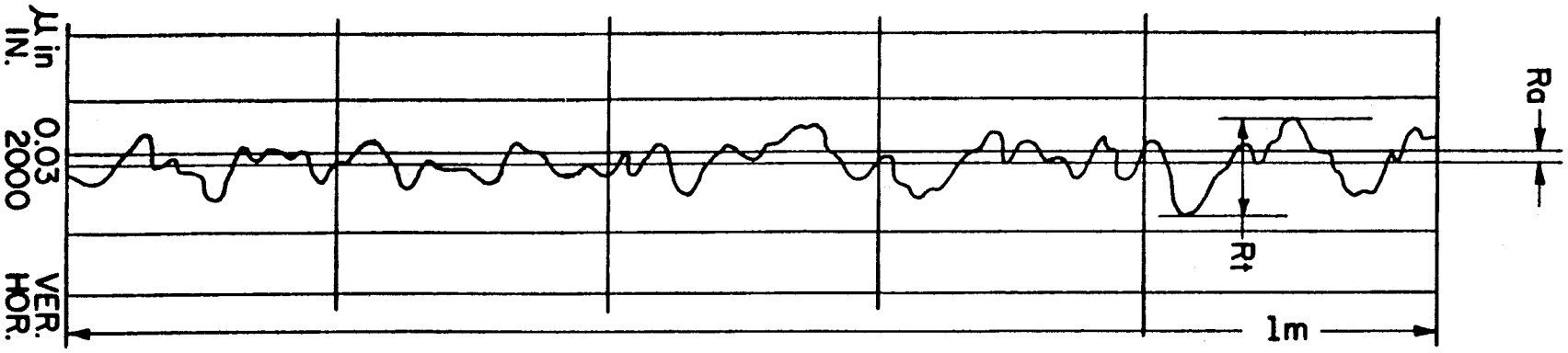
FIG. 10 is an exemplary surface profile for a medium roughness die according to the present invention.
Figure 11:
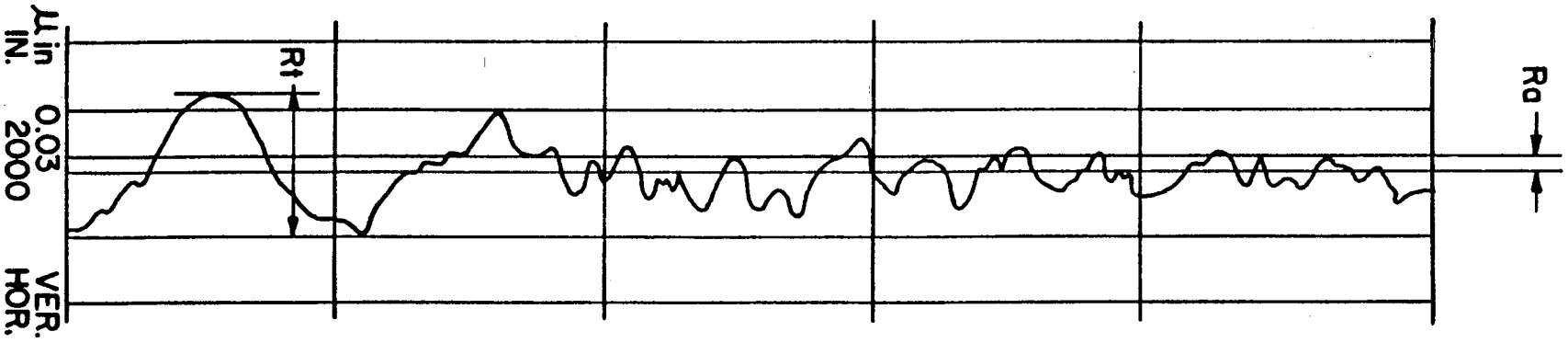
FIG. 11 is an exemplary roughness profile of a coarse die according to the present invention.

Note the height Ra designated in the profiles of FIGS. 10 and 11.

The maximum peak to valley height, Rt, is the distance between the highest peak and the deepest valley of the roughness profile within the evaluation length (1 m). Note the designation of Rt in both FIGS. 10 and 11, and the fact that Rt is considerably higher in the course die illustrated in FIG. 11 compared to the medium roughness die illustrated in FIG. 10.

In both the profiles illustrated in FIGS. 10 and 11, the length 1 m=0.150 in. with each of the five x axis divisions being 0.030 in. Each of the four vertical divisions equals 2,000 uin.

For the single medium roughness die profile illustrated in FIG. 10, has an Ra of 491 uin. and an Rt of 2,960 uin. For the coarse die profile illustrated in FIG. 11, Ra is 693 uin. and Rt is 4,166 uin.

It can be seen by comparing the exemplary profiles in FIGS. 10 and 11, that a large portion of both profiles are very similar. That is, f(x) in FIG. 10 is in fact very similar in magnitude and frequency to profile portion 110 of the coarse die in FIG. 11. However, FIG. 11 exemplary profile has a single high amplitude low frequency portion 111 that produces the large recesses or pits seen in the coarse die photograph of in FIG. 13. The peak to valley height of profile portion 111 is, of course, the Rt for the entire profile (4,166 uin). An increasing number of these large recesses, of course, increases the roughness of the die and in turn the roughness of the abrading tool produced thereby.

It should be understood, of course, that the surface profiles in FIGS. 10 and 11 represent only a single surface profile test run on each of the dies illustrated in FIGS. 12 and 13, but in actuality, a plurality of runs are necessary to properly evaluate overall surface shape or roughness, and yield for the medium die Ra values in the range of 409 uin. to 566 uin., average Ra values over all runs of 486 uin., Rt values in the range of 2,406 uin. to 2,960 uin., and average Rt values of all runs of 2,695 uin.

For the coarse die runs, Ra values range from 359 uin. to 707 uin., average Ra values for all runs are 514 uin., Rt values range from 2,200 uin. to 7,000 uin., and average Rt values of all runs equal 3,783 uin.

Figure 14:
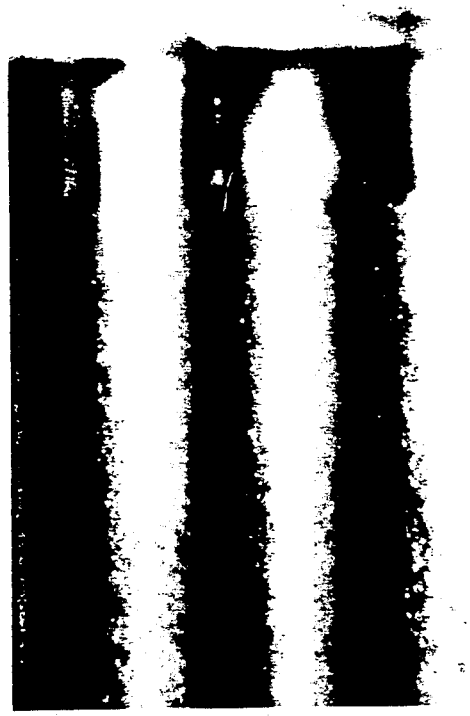
FIG. 14 is a micro photograph (5.3×) of three medium roughness honing rods produced by the die illustrated in FIG. 12.
Figure 15:
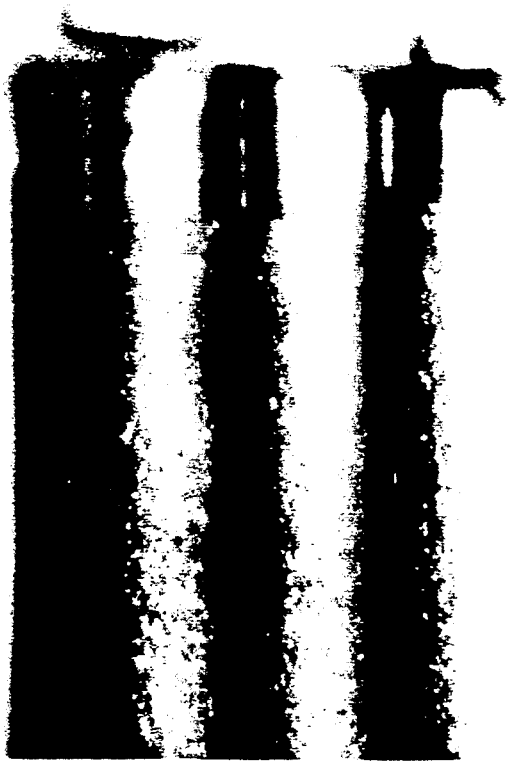
FIG. 15 is a micro photograph (5.3×) of three coarse roughness sharpening rods produced by the coarse die illustrated in FIG. 13.

The photographs of FIGS. 12 to 15 were taken at 5.4 magnification and the pins shown in FIGS. 14 and 15 all have diameters of 0.177 in. The medium die illustrated in FIG. 12 produces an extremely effective honing tool while the coarse die illustrated in FIG. 13 produces an abrading surface in the classification of a knife sharpening or metalworking file.

Figure 16:
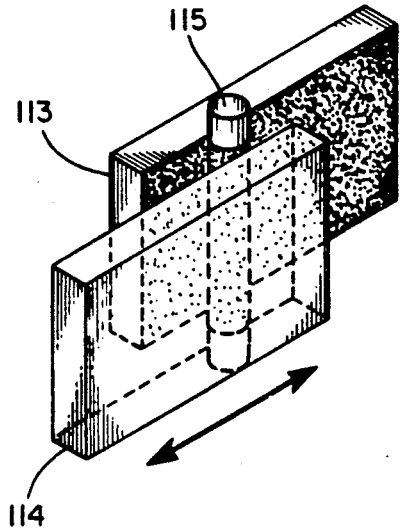
FIG. 16 is a schematic perspective view of two flat dies rolling a rod-shaped abrading tool.
Figure 17:
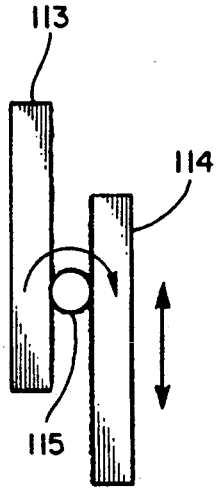
FIG. 17 is a top view of the dies and abrading rod illustrated in FIG. 16.

Viewing FIG. 16, a pair of flat dies 113 and 114 are shown rolling a hardenable steel rod 115. Die 113 is stationary, and die 114 reciprocates in the direction of the arrow illustrated to roll rod 115 for two to four revolutions. The number of revolutions of the rod 115 between the dies controls the uniformity of the surface finish and three to four such revolutions are preferable for superior surface uniformity. This effect is illustrated in FIGS. 14 and 15 where the right rods in each have a single revolution between dies 113 and 114, the middle rods have two revolutions, and the left rods, three revolutions.

Figure 18:
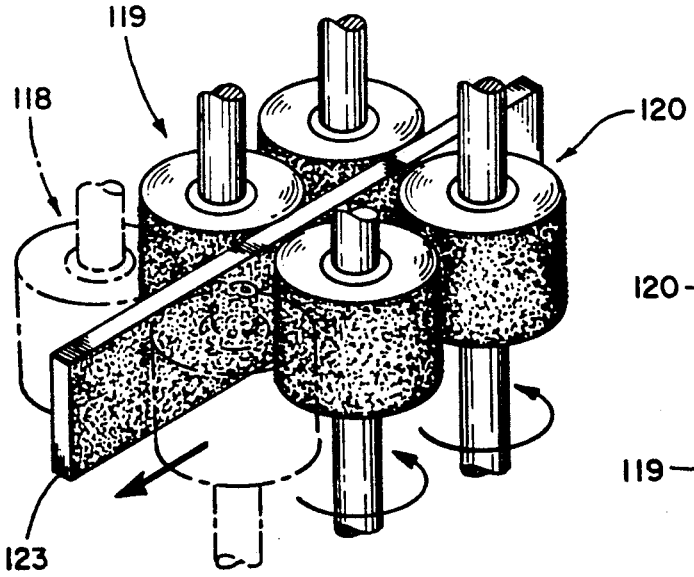
FIG. 18 is a schematic perspective view of three pairs of annular dies forming a flat abrading tool.
Figure 19:
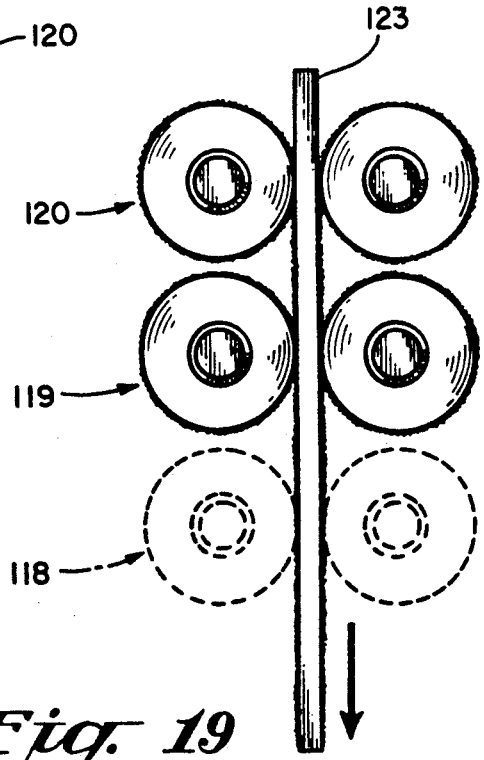
FIG. 19 is a top view of the dies and abrading tool illustrated in FIG. 18.

In FIGS. 18 and 19, three sets of annular dies 118, 119 and 120 are illustrated which rotate as they form the working surfaces on flat hardenable plate 123, which moves in the direction of the arrow illustrated by the rotating die pairs. The rotating die pairs 118, 119 and 120 all have the same roughness working surfaces, but since the surface profile according to the present invention is a random one, the multiple die pairs in effect provide the same uniformity in the surfaces as the multiple rod rotations in the FIGS. 16 and 17 embodiment.

Rods 115 and plate 123, after forming, are heat treated at about 1,700° F. to harden their roughened surfaces.

We claim:

1. A method of making an abrading tool, including the steps of: forming a smooth finish surface on a heat treatable metallic body, forming a relatively rougher surface on the smooth surface having randomly shaped cross sectional profiles with arithmetic mean deviation of roughness (Ra) values in the range of 300 uin. to 800 uin., and heat treating the body to harden the surface sufficiently to produce a metalworking abrading tool, where;

$$Ra = \frac{1}{1m}\int_0^{1m} f(x)dx$$

and 1 m = evaluation length f(x) = y axis defection.

2. A method of making an abrading tool as defined in claim 1, wherein the step of forming a relatively rougher surface includes forming a surface having profiles with arithmetic mean deviation of roughness (Ra) values distributed in the range of 350 uin. to 600 uin. to produce a honing tool.

3. A method of making an abrading tool as defined in claim 2, wherein the step of forming a relatively rougher surface includes forming a surface having profiles with Rt values in the range of 2,200 uin. to about 3,000 uin. wherein Rt is the distance between the highest peak and the deepest valley of a roughness profile within the evaluation length.

4. A method of making an abrading tool as defined in claim 1, wherein the step of forming a relatively rougher surface includes the step of forming a surface having profiles distributed in the range of about 300 uin. to 800 uin. to produce a filing tool.

5. A method of making an abrading tool as defined in claim 4, wherein the step of forming a relatively rougher surface includes forming a surface having profiles with Rt values distributed in the range of 2,000 uin. to 8,000 uin., wherein Rt is the distance between the highest peak and the deepest valley of a roughness profile within the evaluation length to produce a filing tool.

6. A method of making an abrading tool as defined in claim 4, wherein the step of forming a relatively rougher surface includes forming a surface having profiles with Rt values averaging about 3,800 uin. to produce a filing tool.

7. A method of making an abrading tool as defined in claim 3, wherein the step of forming a relatively rougher surface includes forming a surface having a profile with Rt values averaging about 2,700 uin.

8. A method of making an abrading tool as defined in claim 1, wherein the step of forming a relatively rougher surface includes forming a surface having profiles with arithmetic mean deviation of roughness (Ra) values with Ra values averaging 490 uin. to produce a honing tool.

9. A method of making an abrading tool as defined in claim 1, wherein the step of forming a relatively rougher surface includes forming a surface having profiles with arithmetic mean deviation of roughness (Ra) values with Ra values averaging 520 uin. to produce a filing tool.

10. A method of making an abrading tool, including the steps of: forming a smooth finish surface on a heat treatable metallic body, forming a relatively rougher surface on the smooth surface having randomly shaped cross sectional profiles with arithmetic mean deviation of roughness (Ra) values in the range of 350 uin. to 600 uin., and with Rt values in the range of 2,200 uin. to about 3,000 uin. wherein Rt is the distance between the highest peak and the deepest valley of a roughness profile within the evaluation length, to produce a honing tool, and where;

$$Ra = \frac{1}{1m} \int_0^{1m} f(x)dx$$

and 1 m = evaluation length f(x) = y axis defection.

11. A method of making an abrading tool, including the steps of: forming a smooth finish surface on a heat 12 treatable metallic body, forming a relatively rougher surface on the smooth surface having randomly shaped cross sectional profiles with arithmetic mean deviation of roughness (Ra values in the range of 300 uin. to 800 uin., and the step of forming a relatively rougher surface including forming a surface having profiles with Rt values distributed in the range of 2,000 uin. to 8,000 uin. wherein Rt is the distance between the highest peak and the deepest valley of a roughness profile within the evaluation length, and where;

$$Ra = \frac{1}{1m} \int_0^{1m} f(x)dx$$

and 1 m = evaluation length f(x) = y axis defection.

12. A method of making an abrading tool as defined in claim 1, wherein the step of forming the relatively rougher surface includes forming a die with the desired profile and relatively rolling it onto the body.

13. A method of making an abrading tool as defined in claim 12, wherein the step of forming the die includes forming the die with a current controlled electrode in an electrical discharge machine.

14. A method of making an abrading tool, including the steps of: electrical discharge machining of a surface on a die by controlling the current flow in a machining electrode until the surface on the die has randomly shaped cross sectional profiles, heat treating the die to harden the surface, transferring the die profile to a heat treatable body by relatively rolling without grinding the die and body, varying the surface finish on the body by multiple relative revolutions of the die and body to provide a more uniform finish on the body, and heat treating the body to produce an abrading tool.

15. A method of making an abrading tool, including the steps of electrical discharge machining of a surface on a die by controlling the current flow in a machining electrode until the surface on the die has randomly shaped cross sectional profiles, heat treating the die to harden the surface, transferring the die profile to a heat treatable body by relatively rolling the die and body, varying the surface finish on the body by multiple relative revolutions of the die and body to provide a more uniform finish on the body, said step of forming the surface on the die including forming a relatively rougher surface with arithmetic mean deviation of roughness (Ra) values in the range of 300 uin. to 800 uin., where;

$$Ra = \frac{1}{1m} \int_0^{1m} f(x)dx$$

and 1 m = evaluation length f(x) = y axis direction.

16. A method of making an abrading tool as defined in claim 15, wherein the step of forming a relatively rougher surface includes forming a surface having profiles with arithmetic mean deviation of roughness (Ra) values distributed in the range of 350 uin. to 600 uin. to produce a honing tool.

17. A method of making an abrading tool as defined in claim 16, wherein the step of forming a relatively rougher surface includes forming a surface having profiles with Rt values in the range of 2,200 uin. to about 3,000 uin. wherein Rt is the distance between the highest peak and the deepest valley of a roughness profile within the evaluation length.

18. A method of making an abrading tool as defined in claim 15, wherein the step of forming a relatively rougher surface includes the step of forming a surface having profiles distributed in the range of about 300 to 800 to produce a filing tool.

19. A method of making an abrading tool as defined in claim 18, wherein the step of forming a relatively rougher surface includes forming a surface having profiles with Rt values distributed in the range of 2,000 uin. to 8,000 uin. where Rt is the distance between the highest peak and the deepest valley of a roughness profile within the evaluation length.

20. An abrading tool, comprising: a heat treated metallic body having a rough working surface superimposed over a smoother surface, having randomly shaped cross sectional profiles with arithmetic mean deviation of roughness (Ra) values in the range of 300 uin. to 800 uin., where;

$$Ra = \frac{1}{1m} \int_0^{1m} f(x)dx$$

and 1 m = evaluation length f(x) = y axis defection.

21. An abrading tool as defined in claim 20, wherein the arithmetic mean deviation of roughness (Ra) values range from 350 uin. to 600 uin. to define a honing tool.

22. An abrading tool as defined in claim 21, wherein the surface has Rt values in the range of 2,200 uin. to 3,000 uin. wherein Rt is the distance between the highest peak and the deepest valley of a roughness profile within the evaluation length.

23. An abrading tool as defined in claim 20, wherein the arithmetic mean deviation of roughness (Ra) values are distributed in a range of 300 uin. to 800 uin. to define a filing tool.

24. An abrading tool as defined in claim 23, wherein the surface has Rt values distributed in the range of 2,000 uin. to 8,000 uin. wherein Rt is the distance between the highest peak and the deepest valley of a roughness profile within the evaluation length.

25. A method of making a metalworking abrading tool including the steps of: forming a die with randomly shaped profiles on a working surface, heat treating the die to harden the surface, relatively rolling the die and a metallic body without grinding to transfer the profile to a surface on the body, varying the surface finish on the body by multiple relative revolutions of the die and body to provide a more uniform finish on the body, and heat treating the body to harden the body surface and produce an abrading tool.

* * * * *